US009169650B1

(12) United States Patent
Gardner

(10) Patent No.: US 9,169,650 B1
(45) Date of Patent: Oct. 27, 2015

(54) STAIR TREAD

(71) Applicant: William Gardner, Salem, OR (US)

(72) Inventor: William Gardner, Salem, OR (US)

( * ) Notice: Subject to any disclaimer, the term of this patent is extended or adjusted under 35 U.S.C. 154(b) by 0 days.

(21) Appl. No.: 14/558,461

(22) Filed: Dec. 2, 2014

(51) Int. Cl.
*E04F 11/116* (2006.01)
*E04F 11/104* (2006.01)
*E04F 11/112* (2006.01)

(52) U.S. Cl.
CPC ..... *E04F 11/1045* (2013.01); *E04F 11/112* (2013.01); *E04F 11/116* (2013.01)

(58) Field of Classification Search
CPC . E04F 11/021; E04F 11/0212; E04F 11/0214; E04F 11/1045; E04F 11/116
USPC ..... 52/177, 179, 181, 182, 188, 189, 52/309.13, 309.15, 309.16, 309.17, 783.1, 52/784.14, 793.11
See application file for complete search history.

(56) References Cited

U.S. PATENT DOCUMENTS 1,545,181 A * 7/1925 Bechtel ..... 52/179
1,565,580 A * 12/1925 Manton ..... 52/188
1,566,042 A * 12/1925 Schmidt ..... 52/182
1,670,798 A * 5/1928 Connelly ..... 52/179
1,725,541 A * 8/1929 Schick ..... 52/184
1,753,234 A * 4/1930 Cope ..... 52/191
1,771,405 A * 7/1930 Felsenthal ..... 52/191
2,024,032 A * 12/1935 Elgood ..... 52/179
2,073,758 A * 3/1937 Schmeller, Sr. ..... 52/180
2,289,439 A * 7/1942 Kogl ..... 264/334
2,971,238 A * 2/1961 Forssell ..... 264/162
3,055,146 A * 9/1962 Lobato ..... 52/190
3,290,839 A * 12/1966 Theisen ..... 52/188
3,370,387 A * 2/1968 Sivley ..... 52/188
3,466,820 A * 9/1969 Wilfried ..... 52/188
3,557,504 A * 1/1971 Graf ..... 52/179
3,589,087 A * 6/1971 De Lazzero ..... 52/181
3,851,431 A * 12/1974 Klein ..... 182/217
3,857,217 A * 12/1974 Reps ..... 52/592.1
3,875,708 A * 4/1975 Thorsnes ..... 52/189
4,150,175 A * 4/1979 Huettemann ..... 427/209
4,250,672 A * 2/1981 Seegers et al. ..... 52/182
4,285,177 A * 8/1981 Seegers ..... 52/179
4,516,368 A * 5/1985 Pichler ..... 52/190
4,838,005 A * 6/1989 Graham et al. ..... 52/741.2
4,899,504 A * 2/1990 Hirschhorn ..... 52/182
5,014,475 A * 5/1991 Anderson et al. ..... 52/191
5,103,608 A * 4/1992 Andreo ..... 52/179
5,373,674 A * 12/1994 Winter, IV ..... 52/309.9
5,479,746 A * 1/1996 Mannonen ..... 52/182

(Continued)

*Primary Examiner* — Elizabeth A Plummer
*Assistant Examiner* — Kyle Walraed-Sullivan
(74) *Attorney, Agent, or Firm* — Klarquist Sparkman, LLP

(57) ABSTRACT

The present disclosure concerns embodiments of a stair tread which can be installed on a staircase. The stair tread has a metal core at least partially covered with high-strength concrete. In an exemplary embodiment, the core portion has first and second horizontally extending metal plates that are spaced apart vertically from each other, and a grid of vertically extending metal support walls positioned between the first and second metal plates. The core portion can also include retention elements extending upwardly from and distributed across the top of the upper plate for securing the concrete covering to the core.

4 Claims, 2 Drawing Sheets

(56) References Cited

U.S. PATENT DOCUMENTS

| | | | | |
|---|---|---|---|---|
| 5,671,573 | A * | 9/1997 | Tadros et al. | 52/223.8 |
| 5,743,056 | A * | 4/1998 | Balla-Goddard et al. | 52/309.11 |
| 6,101,770 | A * | 8/2000 | Dalton | 52/179 |
| 6,260,313 | B1 * | 7/2001 | Stegmeier | 52/169.7 |
| 6,895,717 | B1 * | 5/2005 | Grinstead | 52/182 |
| 2002/0095897 | A1 * | 7/2002 | Summerford | 52/489.1 |
| 2008/0229703 | A1 * | 9/2008 | Driscoll | 52/747.1 |
| 2009/0038262 | A1 * | 2/2009 | Marschke | 52/793.11 |
| 2009/0142539 | A1 * | 6/2009 | Leng | 428/116 |
| 2014/0333010 | A1 * | 11/2014 | Ciuperca | 264/338 |

* cited by examiner

STAIR TREAD

FIELD

The present disclosure concerns stair treads.

BACKGROUND

Typical concrete stair treads are very heavy and prone to brittle fracture, making them difficult to handle and install, adding significantly to the weight of a stair case, limiting their loading capacity when installed, and creating an earthquake safety hazard. These characteristics can be particularly problematic in multi-story buildings where weight problems are multiplied, and in commercial or industrial settings where ease of installation and safety are critical. Thus, there is a need for a stair tread that is lighter and stronger than conventional concrete stair treads that are currently available.

SUMMARY

The present disclosure concerns embodiments of a stair tread having a core portion formed of metal and/or other strong, light-weight materials, and a concrete portion covering the core portion. The core portion can have a cellular structure, such as a honeycomb shaped structure for example, with many open cell spaces. Such stair treads can provide reduced weight, improved loading capacity, and increased safety compared to comparably sized conventional concrete stair treads.

In an exemplary embodiment, the core portion can comprise upper and lower horizontally oriented metal plates that are spaced apart vertically from each other, and a grid of vertically extending metal support walls positioned between and secured to the bottom surface of the upper plate and the top surface of the lower plate. The grid is distributed across the space between the plates and defines a plurality of polygonal open cells between the vertically extending support walls. For example, the vertically extending support walls can form a honeycomb shape with hexagonal open cells. A plurality of retention elements can extend upwardly from and be distributed across the top surface of the upper plate to facilitate connection to the concrete portion of the stair tread. The concrete portion can cover the metal core portion and be affixed to the plurality of retention elements. The structural aspects of the core portion can comprise any suitable metals or metal alloys, such as aluminum or steel, and/or non-metallic materials.

In some embodiments, the plurality of polygonal open cells between the vertically extending support walls can comprise hexagonal cells. In some embodiments, the concrete portion can cover a top surface of the core portion and front and back surfaces of the core portion.

In other embodiments, the plurality of retention elements can comprise a grid of vertically extending walls extending from the top surface of the first plate. In some embodiments, the grid of the retention elements can define a plurality of polygonal open cells between the vertically extending walls above the first plate. In some embodiments, the polygonal open cells between the vertically extending walls above the first plate can comprise hexagonal cells.

In some embodiments, the first and the second end of the core portion are not covered by the concrete portion. In some embodiments, the core portion can comprise partially formed polygonal cells at a perimeter of the core portion, and at least some of the partially formed polygonal cells can be filled with concrete of the concrete portion. In some embodiments, the bottom surface of the second horizontally extending plate forms a bottom surface of the stair tread.

In some embodiments, the concrete portion can be formed from concrete having a compressive strength of at least 10,000 pounds per square inch. In some embodiments, the first and second plates comprise a first metal and the vertical support walls comprise a second metal different from the first metal. In some embodiments, the grid of vertically extending metal support walls defines a honeycomb-shaped structure. In another exemplary embodiment, the grid of vertically extending metal walls extending from the top surface of the first plate can define a honeycomb-shaped structure.

The foregoing and other objects, features, and advantages of the disclosure will become more apparent from the following detailed description, which proceeds with reference to the accompanying figures.

DETAILED DESCRIPTION

Described herein are embodiments of a stair tread, components thereof, and methods related thereto. The following description is exemplary in nature and is not intended to limit the scope, applicability, or configuration of the technology in any way. Various changes to the described embodiments may be made in the function and arrangement of the elements described herein without departing from the scope of the invention.

The stair treads and components described herein are primarily intended for use with stair construction, but can also be used to form other analogous structures or objects, such as flooring or decking. Thus, although this disclosure proceeds with reference mainly to stairs and stair treads, one of ordinary skill will understand that the inventive features disclosed herein can similarly be applied to other analogous fields of endeavor.

As used herein, the singular forms "a," "an," and "the" refer to one or more than one, unless the context clearly dictates otherwise. That is, if two of a particular element are present, one of these elements is also present and thus "an" element is present. The terms "a plurality of" and "plural" mean two or more of the specified element. As used herein, the term "and/or" used between the last two of a list of elements means any combination of the listed elements. For example, the phrase "A, B, and/or C" means "A," "B," "C," "A and B," "A and C," "B and C" or "A, B and C." As used herein, the term "coupled" generally means physically coupled or linked and does not exclude the presence of intermediate elements between the coupled or associated items absent specific contrary language.

Figure 1:
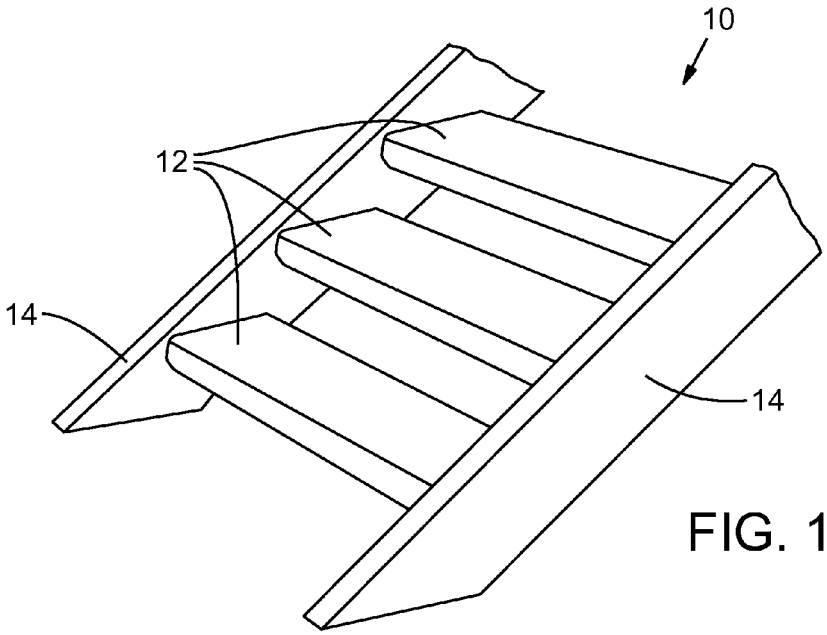
FIG. 1 is a perspective view of a portion of a staircase.

FIG. 1 shows a portion of a typical staircase 10, which can be installed in any type of multi-story structure, such as an office building, hotel, apartment complex, condominium, etc. The staircase 10 comprises a plurality of stair treads 12 (referred to as "treads") suspended between parallel, spaced apart stringers 14. The ends of the treads 12 can be secured to the stringers 14 in various ways. For example, in some embodiments, the ends of the treads 12 can be secured to the stringers 14 by mounting brackets secured to the stringers 14 and configured to receive the ends of the treads 12. The treads can be secured to the brackets with bolts, adhesives, welding, etc. In some embodiments, the stringers include shelves or other features that receive and support the ends of the treads without intermediate brackets. In other embodiments, the treads 12 can be secured to the stringers 14 by placing the treads 12 in respective horizontally-disposed pans and securing the ends of the pans to respective stringers 14 by welding, fasteners, etc.

Regardless of how the ends of the treads 12 are secured to the stringers 14, the treads can be fully suspended by the end connections, such that the combined weight of the tread and any load placed upon it is distributed partially to each stringer. The rear of one tread 12 can be located below and spaced from the front of another tread. The stair case 10 can include openings or gaps between each tread 12, or can include additional components to partially or fully close the gaps between each pair of adjacent treads. When loading occurs, the treads 12 can bow downwardly between the fixed end points, and failure typically occurs by the tread fracturing in the middle or by the failure of the connection between the left and right ends of the tread and the stringers. The disclosed treads provide a lighter weight, stronger tread compared to solid concrete treads by including a partially hollow cellular core that is covered by concrete instead of simply having a solid concrete plank. The provision of the cellular core portion can also provide increased strength, higher loading capacity, and reduced brittleness.

Figure 2:
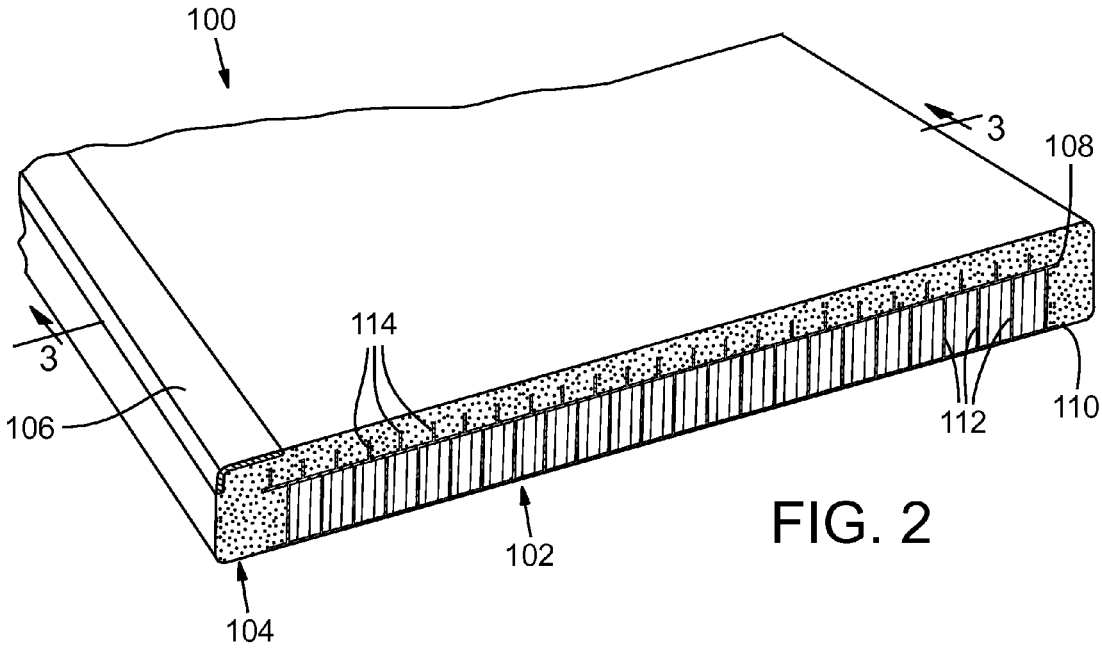
FIG. 2 is a perspective view of an end portion of an exemplary stair tread having a metal core portion covered by a concrete portion.
Figure 3:
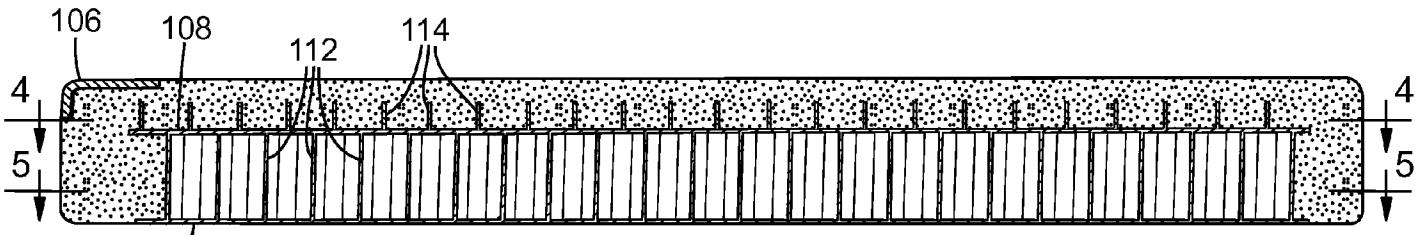
FIG. 3 is a cross-sectional end view of the stair tread of FIG. 2 from the perspective 3-3 as indicated in FIG. 2.

FIGS. 2-5 show an exemplary stair tread 100 that comprises a core portion 102, a concrete portion 104, and an optional nosing 106. FIG. 3 shows a right side end portion of the tread 100. The concrete portion 104 covers at least a portion of the core 102. In the illustrated example, the front, back, and top of the core 102 are covered by the concrete portion 104, and the left and right ends of the core are exposed along with the bottom of the core. In other embodiments, the left and right ends of the core can be covered with concrete as well. The left and right sides of the tread can abut the stringers supporting the tread, and thus there may be no need to provide a concrete layer on the left and right ends of the core. However, it may be desirable to provide a concrete layer covering the front and rear portions of the core for safety and aesthetic reasons.

Any type of nosing can be optionally disposed on and secured to the upper, forward facing edge of the concrete portion 104. Additional information regarding stair tread nosings can be found in U.S. Pat. No. 8,850,757, which is incorporated by reference herein in its entirety.

The core portion 102 can comprise a first or upper horizontally extending plate 108, a second or lower horizontally extending plate 110, a grid of vertically extending support walls 112 positioned between and secured to the bottom surface of the first plate 108 and the top surface of the second plate 110. The core portion 102 can also include retention elements 114 extending upwardly from and distributed across the top surface of the first plate 108, as best shown in FIGS. 2-3. The plates 108, 110, the support walls 112, and the retention elements 114 can be made of any metal or alloys, such as aluminum or steel, and/or can comprise sufficiently strong non-metallic materials. The use of an all metallic core portion is provided as a non-limiting example herein. Welds, adhesives, and/or other materials can also be included in the core portion to secure the components together.

The upper and lower ends of the vertical support walls 112 can be secured to the first and the second metal plates 108, 110 by an adhesive, welding, or similar means. The grid of vertically extending metal support walls 112 can be distributed across most or all of the length and width of the first and second plates 108, 110. The combination of the horizontal plates 108, 110 and the vertical support walls 112 forms a grid or network of empty polygonal cells 116. In some embodiments, as shown, the walls 112 and the cells 116 can be configured in a honeycomb structure with each cell having a hexagonal horizontal cross-section. Each cell is capped on the top by the first plate 108 and capped on the bottom by the second plate 110. In other embodiments, the cells 116 of the core portion 102 can comprise various other shapes and/or sizes that the example illustrated. For example, the cells can have a square, triangular, or other polygonal cross-sectional shape, or can have circular, elliptical, or irregular cross-sectional shapes.

The vertical support walls 112 can be a plurality of strips which are bent and secured together at certain locations such that their junctures form the empty cells in between the strips. Each of the strips can extend the full vertical distance between the two plates.

At the left, right, front, and/or back of the core portion 102, the perimeter of the vertical support walls 112 can form partial cells. At the front and back, for example, the partial cells can be filled in with concrete, while the left and right ends, for example, can be left empty and exposed.

Figure 4:
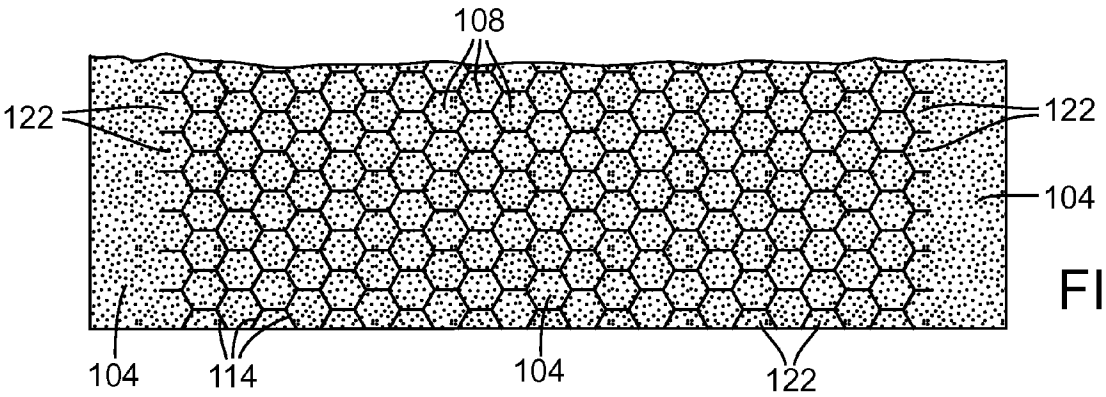
FIG. 4 is a cross-sectional top view of the stair tread of FIG. 2 from the perspective 4-4 as indicated in FIG. 3.
Figure 5:
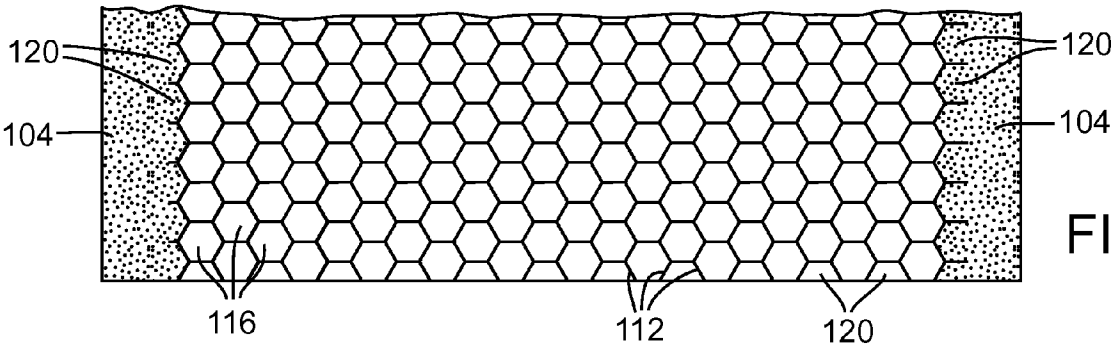
FIG. 5 is a cross-sectional top view of the stair tread of FIG. 2 from the perspective 5-5 as indicated in FIG. 3.

The plurality of retention elements 114 extending from the top of the upper plate 108 can be secured to the top surface of the upper plate 108 by an adhesive, welding, etc. In some embodiments, the retention elements 114 can comprise a grid of vertically extending walls (similar to the support walls 112). In other embodiments, the retention elements 114 can comprise various other configurations, such as independent ridges, hooks, bumps, grooves, etc., which help to retain the concrete portion 104 to the core portion 102. The retention elements 114 can have any height and spacing. In the illustrated embodiment, the retention elements 114 form a hexagonal grid defining a plurality of open-topped cells 118 having a polygonal cross-section, as shown in FIG. 4. As shown, the walls and the cells 118 can be configured in a honeycomb structure, which have any size of cells. In some embodiments, the cells 118 can be, for example, hexagonal. While the cells 116 and the cells 118 are illustrated having substantially similar cross-sectional shapes and sizes, as shown in FIGS. 4 and 5, in other embodiments the cells 116 and 118 can be configured such that the cells 116 differ from cells 118 in shape, size, material, etc. As best shown in FIGS. 4 and 5, a portion of the cells 116, 118 can be partially formed, open sided cells 120, 122, respectively, which define a perimeter around the respective enclosed cells 116, 118. The retention elements 114 and a portion of the partially formed cells 120, 122 can be configured to receive concrete, thereby bonding or affixing the core portion 102 and the concrete portion 104 together.

The concrete portion 104 covers at least a portion of the core portion 102. In some embodiments, the concrete portion 104 can cover the front, back, and top surfaces of the core portion 102, leaving the bottom and end surfaces of the core 102 exposed, as shown in FIG. 2. By leaving the bottom and/or end surfaces of the core 102 exposed, the stair tread 100 can, for example, be more easily secured to a pan, bracket, and/or stringer of a staircase. For example, a stair tread 100 with the bottom surface of the second metal plate 110 exposed can be easily secured to a pan, bracket, and/or stringer by inserting a fastener (e.g., screw) through the pan, bracket, and/or stringer and into the second metal plate 110, or vice versa. The metal plates 108, 110 can be more easily and more strongly secured (e.g., welded, adhesively bonded, or drilled and bolted) to the supporting stringers compared to conventional all-concrete treads.

In other embodiments, the concrete portion 104 can cover the entire core 102. For example, the core portion 104 can be complete encased in concrete, including on the lower side of the core portion. This embodiment can, for example, provide the appearance of an all-concrete tread while still provided enhanced performance and safety benefits of including the metal core.

The concrete portion 104 can be formed from high strength concrete and/or ultra-high performance concrete. For example, in one embodiment the concrete portion is formed from concrete comprising about 75% cement and about 25% fly ash and sand, by mass. In some embodiments, the concrete portion 104 can be formed without or substantially without aggregate or can be fabricated without or substantially without coarse aggregate. The concrete portion 104 can have a compressive strength of at least 6,000, and/or at least 10,000 pounds per square inch ("PSI") (e.g., about 10,500 PSI); whereas, ordinary concrete used in conventional stair treads may have a compressive strength of approximately 3,000 PSI.

The disclosed stair treads can have any dimensions, and are not limited to the proportions shown in the drawings. For example, tread can have any length, width, or thickness. The core portion can and the concrete portion can have any relative thickness ratio. The horizontal dimensions of the cells 116 and 118 can be any size, and can have any ration relative to the overall size dimensions of the plates 110, 112 or the overall tread. The thickness of the concrete portions provided in front of and behind the core portion can also have any dimension.

The disclosed stair treads can, advantageously, provide a stair tread that is significantly lighter than an all-concrete stair tread having the same dimensions. For example, a common stair tread can have an end-to-end length of 48 inches, a front-to-back width of 12 inches and a top-to-bottom thickness of 1.5 inches. At such dimensions, an embodiment of the illustrated stair tread 100, having an all-aluminum core portion 102 and ultra-high performance concrete portion 104, can weigh less than 50 pounds, less than 45 pounds, less than 40 pounds, less than 35 pounds and/or less than 30 pounds, depending on the materials, proportions, and thicknesses of the core materials; whereas, a typical all-concrete tread having similar dimensions can weigh approximately 70-75 pounds, depending on the density of the concrete. By significantly reducing the weight, the disclosed stair treads can be more easily transported and installed, and can reduce the overall weight of a stair case in a building.

The disclosed stair treads can also, advantageously, be significantly stronger than a conventional all-concrete stair tread. When, for example, a 48"×12"×1.5" embodiment of the stair tread 100 was loaded with 900 pounds in the middle of the top of the tread 100, relative to the side-to-side width, the middle of the tread deflected less than or equal to about 3/16 of an inch. (Such strength properties can be increased even further by increasing the thickness of the plates and/or the vertical walls, by using steel instead of aluminum, and/or by other means.) This is a significant improvement over analogous typical all-concrete stair treads which deflect more than ½ of an inch and/or fracture under such a heavy load. Furthermore, the metal core 102 can provide increased ductility compared to all-concrete treads, which allows the tread to plastically deform or strain to a greater degree when overloaded prior to fracturing. By significantly improving the strength and reducing brittleness compared to all-concrete treads, the stair treads disclosed herein can be safer, particularly in earthquake-prone locations and/or during other high stress emergency situations.

In view of the many possible embodiments to which the principles disclosed herein may be applied, it should be recognized that the illustrated embodiments are only examples and should not be taken as limiting the scope of the disclosure. Rather, the scope of the disclosure is at least as broad as the following claims. I therefore claim all that comes within the scope of these claims.

The invention claimed is:

1. A stair tread comprising:

a core portion comprising upper and lower horizontal metal plates that are spaced apart vertically from each other, and a grid of metal support walls positioned between and secured to the upper and lower plates, wherein the grid defines a plurality of hexagonal open cells between upper and lower plates and the grid of support walls; and a concrete portion at least partially covering and affixed to the core portion;

wherein the concrete portion covers a top side, a front side, and a rear side of the core portion; and wherein a lower side, a left end side, and a right end side of the core portion are not covered by the concrete portion.

2. The stair tread of claim 1, wherein the grid of metal support walls and the plurality of hexagonal open cells forms a honeycomb configuration when viewed along a horizontal cross-section.

3. The stair tread of claim 1, wherein the core portion further comprises a grid of metal retention walls positioned above and secured to the upper plate, wherein the grid of metal retention walls defines a plurality of hexagonal cells above the upper plate.

4. The stair tread of claim 3, wherein the plurality of hexagonal cells above the upper plate are at least partially filled with concrete of the concrete portion to affix the concrete portion to the core portion.

* * * * *